US010253275B2

(12) United States Patent
Latunski

(10) Patent No.: US 10,253,275 B2
(45) Date of Patent: Apr. 9, 2019

(54) HIGH VISCOSITY LUBRICANTS WITH POLYETHER

(71) Applicant: American Chemical Technologies, Inc., Fowlerville, MI (US)

(72) Inventor: Mark D. Latunski, Morrice, MI (US)

(73) Assignee: American Chemical Technologies, Inc., Fowlerville, MI (US)

( * ) Notice: Subject to any disclaimer, the term of this patent is extended or adjusted under 35 U.S.C. 154(b) by 0 days.

(21) Appl. No.: 15/654,353

(22) Filed: Jul. 19, 2017

(65) Prior Publication Data

US 2019/0024013 A1 Jan. 24, 2019

(51) Int. Cl.

| | |
|---|---|
| ***C10M 111/04*** | (2006.01) |
| ***C10M 145/30*** | (2006.01) |
| ***C10M 145/36*** | (2006.01) |
| ***C10M 169/04*** | (2006.01) |
| ***C10M 175/00*** | (2006.01) |
| ***C10M 175/02*** | (2006.01) |

(52) U.S. Cl.

CPC ..... *C10M 145/30* (2013.01); *C10M 111/04* (2013.01); *C10M 145/36* (2013.01); *C10M 169/041* (2013.01); *C10M 175/0091* (2013.01); *C10M 175/02* (2013.01); *C10M 2201/062* (2013.01); *C10M 2203/1025* (2013.01); *C10M 2209/105* (2013.01); *C10M 2209/108* (2013.01); *C10M 2209/1055* (2013.01); *C10N 2220/022* (2013.01); *C10N 2230/02* (2013.01); *C10N 2230/04* (2013.01); *C10N 2230/40* (2013.01); *C10N 2230/72* (2013.01); *C10N 2240/04* (2013.01); *C10N 2240/08* (2013.01)

(58) Field of Classification Search

CPC ..... C10M 2207/283
USPC ..... 508/485
See application file for complete search history.

(56) References Cited

U.S. PATENT DOCUMENTS

| | | | | |
|---|---|---|---|---|
| 4,370,247 | A | 1/1983 | Ostyn | |
| 5,037,566 | A | 8/1991 | Randisi | |
| 5,465,810 | A | 11/1995 | Peterson et al. | |
| 5,485,895 | A | 1/1996 | Peterson et al. | |
| 5,602,085 | A | 2/1997 | Peterson et al. | |
| 5,808,131 | A * | 9/1998 | Gruenbauer | C08G 18/10 560/25 |
| 6,127,324 | A | 10/2000 | Tolka et al. | |
| 6,245,720 | B1 | 6/2001 | Bacarella | |
| 6,255,263 | B1 | 6/2001 | Ryan | |
| 6,436,883 | B1 | 8/2002 | Nieh | |
| 8,796,189 | B2 | 8/2014 | Lalla | |
| 8,969,271 | B2 | 3/2015 | Greaves et al. | |
| 9,200,230 | B2 | 12/2015 | Youn et al. | |
| 2007/0040148 | A1 | 2/2007 | Short | |
| 2009/0247436 | A1 | 10/2009 | Wardlow et al. | |
| 2010/0093574 | A1 | 4/2010 | Nagakari et al. | |
| 2013/0261035 | A1 * | 10/2013 | Kovanda | C10M 145/30 508/579 |
| 2013/0281332 | A1 | 10/2013 | Butke et al. | |
| 2014/0194332 | A1 | 7/2014 | Kamata et al. | |
| 2015/0099675 | A1 | 4/2015 | Hum et al. | |
| 2015/0299603 | A1 | 10/2015 | Vinci et al. | |
| 2016/0122678 | A1 | 5/2016 | Akucewich et al. | |

FOREIGN PATENT DOCUMENTS

| | | | |
|---|---|---|---|
| EP | 0796908 | A1 | 9/1997 |
| WO | 1996011244 | | 4/1996 |
| WO | 2001085879 | A1 | 11/2001 |
| WO | 2013010851 | A1 | 1/2013 |
| WO | 2013148743 | A2 | 10/2013 |
| WO | 2014207172 | A1 | 12/2014 |

OTHER PUBLICATIONS

Dow; Taking Quality and Performance to the Next Level; Sustainable Solutions for Coating, Adhesives, Sealants and Elastomers; Jun. 2013.*

Khemchandani, G.: "Non-varnishing and tribological characteristics of polyalkylene glycol-based synthetic turbine fluid", Lubrication Science, vol. 24, No. 1, Jan. 10, 2012, pp. 11-21, XP055065824, ISSN: 0954-0075, DOI: 10.1002/Is.165.

International Search Report and Written Opinion for PCT/US2018/042651 dated Oct. 9, 2018.

* cited by examiner

*Primary Examiner* — Vishal V Vasisth

(74) *Attorney, Agent, or Firm* — Honigman LLP; Anna M. Budde

(57) ABSTRACT

Disclosed is a method of treating a used hydrocarbon lubricant of ISO Viscosity Grade 46 or higher comprising oxidation products that adversely affect lubricant performance. The hydrocarbon lubricant has a Group II hydrocarbon oil or Group III hydrocarbon oil, optionally one or more lubricant additives, and an amount of varnish. The hydrocarbon lubricant is free of zinc-containing additives. The method comprises adding to the used hydrocarbon lubricant from about 2 percent by weight to about 20 percent by weight of a polyhydroxy polypropylene oxide homopolymer that has a hydroxyl number of from about 12 mg KOH/g to about 58 mg KOH/g as measured according to ASTM D4274.

24 Claims, No Drawings

HIGH VISCOSITY LUBRICANTS WITH POLYETHER

FIELD OF THE INVENTION

The present invention relates to methods for extending service life of higher viscosity lubricants, having ISO Viscosity Grades 100 and higher, such as industrial gear oils.

INTRODUCTION TO THE DISCLOSURE

This section provides information helpful in understanding the invention but that is not necessarily prior art.

Group II and Group III hydrocarbon oils can be used to formulate lubricants, including medium viscosity gear lubricants (e.g., ISO VG 46 to ISO VG 150 lubricants according to ISO 3448, which have kinematic viscosities at 40° C. of about 42 centistokes to about 170 centistokes), high viscosity gear lubricants (e.g., ISO VG 220, ISO VG 320, and ISO VG 460 lubricants according to ISO 3448, which have kinematic viscosities at 40° C. above 200 centistokes), and greases (e.g., ISO VG 1500). Group II oils are obtained from fractionally distilled petroleum that has been hydrocracked to further refine and purify it. Group III oils have characteristics similar to Group 11 oils, with the oils of Groups II and III both being highly hydro-processed oils that have undergone various steps to improve their physical properties. Group III oils have higher viscosities than do Group II oils and are prepared either by further hydrocracking Group II oils or by hydrocracking hydro-isomerized slack wax, which is a by-product of the dewaxing process used for many oils in general.

Hydrocarbon oils and greases, including Group II and Group III hydrocarbon oils and greases, are susceptible to oxidation at the common use temperatures of many lubricants. Over time, agglomerated, oxidized hydrocarbon ("varnish") forms and causes an increase in viscosity, especially during high temperature uses. Varnish in the oil also reduces the efficacy of the lubricant, and deposition of varnish on working surfaces may interfere with operation of machinery. Agglomerated varnish reaches a size or polarity at which the agglomerated varnish drops out of the lubricant as sludge, which blocks filters and accumulates in reservoirs or elsewhere in areas of the machine or other apparatus containing the lubricant. Lubricant additives, such as sulfides, sulfates, and phosphates, can become entrained in varnish agglomerates and thereby lose their effectiveness.

Over the years, a number of approaches have been taken in formulating lubricants to forestall the problems of shortened lubricant life due to buildup of hydrocarbon oil oxidation products in the lubricant itself and on surfaces of the lubricated equipment. Antioxidants are common, but expensive, lubricant additives employed to delay or slow formation of varnish and sludge. Dispersants are added to keep soft varnish particles suspended in a hydrocarbon lubricant, but dispersants are often not a satisfactory solution because the dispersant-vanish micelles eventually increase lubricant viscosity and affect performance of the lubricant. Other lubricant additives are dispersed compounds containing zinc, sulfur, phosphorus, or a combination of these that have a tendency to become entrained in varnish agglomerates. Examples of these additives may include amine phosphates, phosphate esters, zinc dialkyldithiophosphates (ZDDP), zinc diamyldithiocarbamate, and diamyl ammonium diamyldithiocarbamate. Additionally, such lubricant additives are expensive and may be subject to regulations, e.g. for disposal.

The petroleum industry over the years has eliminated some of the impurities from crude oil via hydrocracking or produced synthetic hydrocarbons to extend lubricant oil service life. In addition, varnish prediction test methods and varnish removal filters, used to filter out the varnish agglomerates and sludge that degrade lubricant performance, can be employed to extend lubricant lifespan. Filters work best when the lubricant has a relatively low viscosity, for examples lubricants that are ISO Viscosity Grade 68 and lower. In spite of such efforts it still becomes necessary after a period of time in use to remove used hydrocarbon lubricant that has filled with sludge and varnish and recharge the system with new lubricant.

There has been interest in using polyalkylene glycols as lubricant additives due to their good low oxidation potential and hydrolytic stability, but unmodified polyalkylene glycols are known to have little or no solubility in hydrocarbon oils and so have not been used in formulating hydrocarbon oil lubricants. For example, Greaves, US Patent Application Publication 2012/0108482 teaches etherifying a polyalkylene glycol with a $C_8$-$C_{20}$ alcohol to obtain solubility in a hydrocarbon oil. Polyalkylene glycols have also been used as complete replacement oils for hydrocarbon oils, but this is not practical in many cases because of formulation and economic considerations.

Kovanda et al., U.S. Pat. No. 8,685,905 discloses a method in which an aliphatic polyether selected from polyalkylene oxides with monomer units having 3 to about 10 carbon atoms and polyvinyl ethers with ether groups having 2 to about 8 carbon atoms is introduced into a used hydrocarbon lubricant containing oxidation products (i.e., sludge and varnish), with the oxidation products being dissolved by the addition of the polyether or polyvinyl ether. The treated hydrocarbon lubricant can then continue to be used in the machinery. The polyalkylene oxides have one hydroxyl and one hydrocarbyl end group. However, it has been found that the Kovanda method is less effective in treating medium and high viscosity hydrocarbon lubricants that contain varnish and sludge, such as gear lubricants, than it is in treating lubricants with lower viscosities. It is noted that varnish develops more quickly in medium and high viscosity hydrocarbon lubricants. Therefore, there remains a need for a more effective method to extend the service life of gear lubricants and other hydrocarbon lubricants of ISO Viscosity Grades 46 and higher.

SUMMARY OF THE DISCLOSURE

This section provides a general summary of what is disclosed in the detailed description and claims that follow rather than a comprehensive disclosure of the full scope of the invention and all its features.

Now disclosed is a method of treating a used hydrocarbon lubricant of ISO Viscosity Grade 46 or higher (classified according to ISO 3448) comprising agglomerated or deposited varnish that adversely affects lubricant performance. The used hydrocarbon lubricant has a Group II oil or Group III oil as the base oil, optionally includes one or more lubricant additives, and either (1) contains varnish that manifests as sludge or agglomerated varnish that causes an increase in hydrocarbon lubricant viscosity compared to viscosity of the hydrocarbon lubricant as originally formulated (i.e., new or unused hydrocarbon lubricant) or (2) that is determined by at least one of: a change in amount of atomic oxygen of at least 0.3 wt %, or an increase in Varnish Potential Rating to Elevated or higher, or an increase in $\Delta E$ of at least about 25 in the Membrane Patch Colorimetry test, wherein each of these three changes is determined by a comparison to the hydrocarbon lubricant as originally formulated (properties of an unused hydrocarbon lubricant of the lubricant's formulation). The hydrocarbon lubricant is free of free of zinc dialkylthiophosphate and other zinc coordination compounds and is preferably free of additives dispersed with surfactants and dispersants. The hydrocarbon lubricant is other than a lubricant used in an internal combustion engine. The method comprises adding to the used hydrocarbon lubricant from about 2 percent by weight to about 20 percent by weight of a polypropylene oxide, based on weight of the used hydrocarbon lubricant. The polypropylene oxide has at least two hydroxyl groups and has a hydroxyl number of from about 12 mg KOH/g to about 58 mg KOH/g as measured according to ASTM D4274. The polypropylene oxide is a homopolymer and can be branched (a polypropylene oxide homopolymer with two or more hydroxyl groups) or can be linear (a dihydroxy, linear polypropylene oxide homopolymer).

While not wishing to be bound by theory, it is believed that adding the polypropylene oxide homopolymer having at least two hydroxyl groups and having a hydroxyl number of from about 12 mg KOH/g to about 58 mg KOH/g (the "polyhydroxy polypropylene oxide homopolymer") causes the oxidized hydrocarbon oil varnish to be dissolved in the used hydrocarbon lubricant along with the polyhydroxy polypropylene oxide homopolymer. The used hydrocarbon lubricant treated by adding the polyhydroxy polypropylene oxide homopolymer has a reduced amount of the agglomerated varnish and/or sludge, which allows for continued use of the used hydrocarbon lubricant. Further, oxidized hydrocarbon oil sludge that forms in the used hydrocarbon lubricant contains lubricant additives that were originally part of the hydrocarbon lubricant but were drawn out of the lubricant by becoming entrained in agglomerated varnish that precipitated from the used hydrocarbon lubricant. The disclosed method of treating the hydrocarbon lubricant may thus also increase the concentration of one or more lubricant additives that had been precipitated from the hydrocarbon lubricant with the varnish sludge by reincorporating those additives into the used hydrocarbon lubricant. One or more lubricant additives may be added as part of a composition also comprising the polyhydroxy polypropylene oxide homopolymer having a hydroxyl number of from about 12 mg KOH/g to about 58 mg KOH/g that is added to the used hydrocarbon oil, with the additive being dispersed or dissolved in the polyhydroxy polypropylene oxide homopolymer. In this way, an additive that has been at least partially consumed, precipitated, filter out, or otherwise lost during use of the hydrocarbon lubricant may be brought back to its original concentration in the hydrocarbon lubricant; or a lubricant additive package of the hydrocarbon lubricant may be modified by including an additive not previously present in the hydrocarbon lubricant or by increasing the concentration of an additive over its previous concentration in the hydrocarbon lubricant. The method may also in some cases re-dissolve varnish film deposited on surfaces contacting the hydrocarbon lubricant.

In an embodiment of the method, the used hydrocarbon lubricant has an ISO Viscosity Grade of at least 46 and up to an ISO Viscosity Grade 1500 (classified according to ISO 3448), comprises a Group II oil or Group III oil, contains varnish or sludge, and may contain one or more lubricant additives. The hydrocarbon lubricant is free of zinc dialkylthiophosphate and other zinc coordination compounds and preferably is free of additives dispersed with surfactants and/or dispersants. The hydrocarbon lubricant is other than a lubricant being used in an internal combustion engine. The method comprises adding to the used hydrocarbon lubricant from about 2 percent by weight to about 20 percent by weight of a polyhydroxy polypropylene oxide homopolymer, based on the weight of the used hydrocarbon lubricant, wherein the polyhydroxy polypropylene oxide homopolymer has a hydroxyl number of from about 12 mg KOH/g to about 58 mg KOH/g as measured according to ASTM D4274. In certain embodiments the polyhydroxy polypropylene oxide homopolymer may have a hydroxyl number of from about 12 mg KOH/g to about 32 mg KOH/g. The polyhydroxy polypropylene oxide homopolymer may be added to the used hydrocarbon lubricant as part of a composition further comprising one or more lubricant additives, for example an antioxidant such as a phenolic antioxidant, an antifoam additive, a corrosion inhibitor, or combinations of these additives.

Also described is a method of treating a used hydrocarbon lubricant in which the content of atomic oxygen has changed by at least about 0.3 weight percent or at least about 0.4 weight percent or at least about 0.5 weight percent compared to the weight percent of atomic oxygen of the hydrocarbon lubricant as formulated. Weight percent of atomic oxygen is determined based on the fully formulated hydrocarbon lubricant; that is, based on the total weight of the hydrocarbon oil and any additives in the hydrocarbon lubricant. The method may be used to treat used hydrocarbon lubricant in which the content of atomic oxygen is changed from 0.3 weight percent or from about 0.4 weight percent or from about 0.5 weight percent to about 0.7 weight percent or to about 0.8 weight percent or to about 0.9 weight percent or to about 1 weight percent as compared to the weight percent of atomic oxygen of the hydrocarbon lubricant as formulated. The hydrocarbon lubricant is ISO Viscosity Grade 46 or higher, in particular from ISO Viscosity Grade 46 up to ISO Viscosity Grade 1500 (classified according to ISO 3448), and comprises a Group II oil or Group III oil and optionally one or more lubricant additives. The hydrocarbon lubricant is free of zinc dialkylthiophosphate and other zinc coordination compounds and preferably free of additives dispersed with surfactants and/or dispersants; it is not being used in an internal combustion engine. The method comprises adding to the used hydrocarbon lubricant with the changed weight percent of atomic oxygen from about 2 percent by weight to about 20 percent by weight of a polypropylene oxide, based on the weight of the used hydrocarbon lubricant. The polypropylene oxide added is a polyhydroxy polypropylene oxide homopolymer having a hydroxyl number of from about 12 mg KOH/g to about 58 mg KOH/g as measured according to ASTM D4274.

The weight percent of atomic oxygen in hydrocarbon lubricants is determined by elemental analysis using atomic absorption spectroscopy. The weight percent of atomic oxygen in hydrocarbon lubricant may be estimated with fair precision by determining a change in the density of the hydrocarbon lubricant as compared to its density as formulated (i.e., before use) using the method described in Mikiniori Kuwata et al., "Using elemental ratios to predict the density of organic material composed of carbon, hydrogen, and oxygen," Environ. Sci. Technol. 46(2) pp. 787-94 (Jan. 29, 2012). Density is measured according to ASTM D4052. The weight percent of atomic oxygen in the hydrocarbon lubricant as formulated may alternatively be calculated from its formulation.

As used in describing the technology disclosed herein, "varnish" refers to oxidized hydrocarbon oil that has agglomerated. Varnish can be detected by and measured by ASTM D7843. Varnish may become attached to or deposited on surfaces of machinery exposed to the hydrocarbon lubricant to form a varnish film. As used in describing the technology disclosed herein, "sludge" refers to varnish that precipitates from the hydrocarbon lubricant and that may be have entrained hydrocarbon lubricant additives such as sulfides, sulfates, and phosphates. The present method treats varnish in used hydrocarbon lubricant. After the used hydrocarbon lubricant is treated by the presently disclosed method, re-incorporating the varnish into the hydrocarbon lubricant, precipitated lubricant additives not reincorporated may be more easily filtered from the hydrocarbon lubricant. An amount of an additive or additives may be added to the hydrocarbon lubricant to replace the additive or additives removed by filtration, for example in a composition with the polyhydroxy polypropylene oxide homopolymer having a hydroxyl number of from about 12 mg KOH/g to about 58 mg KOH/g.

The amount of varnish in a hydrocarbon lubricant and the lubricant's Varnish Potential Rating are measured by Membrane Patch Colorimetry, ASTM D7843. Lubricant manufacturers recommend removing and replacing a lubricant with a Varnish Potential Rating of Elevated or higher. A Varnish Potential Rating is determined by ASTM D 4378. The following published test methods may be used to characterize used hydrocarbon lubricant:

VP Pentane Insolubles—ASTM D893
Ultra-Centrifuge Sediment Rating—Mobil Method 1169
Membrane Patch Colorimetry—ASTM D7843
Ruler %—ASTM D 6971
Total Acid Number—ASTM D 664
Water Content—ASTM E 203
Particle Count—ISO 4406
Viscosity—ASTM D4052

All test methods mentioned throughout this document refer to the current test method version in effect at the time this application was first filed (earliest priority date).

In various embodiments, the used hydrocarbon lubricant has a kinematic viscosity at 40° C. of from about 40 centistokes to about 352 centistokes or has an ISO Viscosity Grade of from 46 to 320, measured according to ISO 3448 and the method comprises adding to the used hydrocarbon lubricant from about 2 percent by weight to about 20 percent by weight, based on the weight of the used hydrocarbon lubricant, of a polyhydroxy polypropylene oxide homopolymer, wherein the polyhydroxy polypropylene oxide homopolymer has a hydroxyl number of from about 25 mg KOH/g to about 58 mg KOH/g, as measured according to ASTM D4274, for example a hydroxyl number of from about 25 mg KOH/g to about 32 mg KOH/g. In other embodiments, the used hydrocarbon lubricant or has a kinematic viscosity at 40° C. of from about 288 centistokes to about 1650 centistokes or has an ISO Viscosity Grade of from 320 to 1500, measured according to ISO 3448, and the method comprises adding to the used hydrocarbon lubricant from about 2 percent by weight to about 20 percent by weight, based on the weight of the used hydrocarbon lubricant, of a polyhydroxy polypropylene oxide homopolymer, wherein the polyhydroxy polypropylene oxide homopolymer has a hydroxyl number of from about 12 mg KOH/g to about 20 mg KOH/g as measured according to ASTM D4274, for example a hydroxyl number of from about 12 mg KOH/g to about 16 mg KOH/g.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range.

Further variations will become apparent from the description that follows. It should be understood that the description and specific examples are intended for purposes of illustration only.

DETAILED DESCRIPTION

A detailed description of exemplary, nonlimiting embodiments follows.

The used hydrocarbon lubricant that is treated in the disclosed method comprises either a Group II hydrocarbon oil or a Group III hydrocarbon oil according to API 1509, Appendix E. Group II hydrocarbon oils are defined as containing more than 90 percent saturates, containing less than 0.03 percent sulfur, and having a viscosity index of 80 to 120. Group III hydrocarbon oils contain greater than 90 percent saturates, contain less than 0.03 percent sulfur, and have a viscosity index above 120. Both Group II and Group III hydrocarbon oils may be manufactured by hydrocracking, while Group III oils are generally severely hydrocracked at higher pressure and heat to obtain a higher purity. Group II and Group III hydrocarbon oils are widely available commercially. The used hydrocarbon lubricant may optionally contain one or more lubricant additives.

The used hydrocarbon lubricant has an ISO Viscosity Grade of 46 or higher or a viscosity as measured according to ASTM D445 of 40 or higher. The used hydrocarbon lubricant's ISO Viscosity Grade may be, for example, from 46 to 1500. In various embodiments, the used hydrocarbon lubricant's ISO Viscosity Grade may be one of ISO Viscosity Grades 46, 68, 100, 150, 220, 320, 460, 680, 1000, and 1500. Such hydrocarbon lubricants find use, for example, as hydraulic pump oils, industrial gear lubricants and greases. Industrial gear lubricants are specifically distinguished from automotive gear oils, which are subject to operating challenges distinct from industrial gear lubricants and are therefore formulated differently. The used hydrocarbon lubricants treated in the present method are free of zinc dialkylthiophosphate and other zinc coordination compounds and may preferably be free of additives dispersed with surfactants and/or dispersants. In particular, the used hydrocarbon lubricants treated in the present method are free of zinc dialkylthiophosphate and other zinc coordination compounds.

A hydrocarbon lubricant is exposed to oxidative conditions during use, and over time the amount of varnish in the hydrocarbon lubricant increases to a point at which it negatively affects performance of the apparatus containing the hydrocarbon lubricant. The used hydrocarbon lubricant is then advantageously treated according to the method now disclosed. In various embodiments, the used hydrocarbon lubricant is subjected to the presently disclosed method when it contains varnish detectable by ASTM D7843. In various embodiments, the used hydrocarbon lubricant is subjected to the presently disclosed method when it contains varnish: (1) that manifests as sludge or agglomerated varnish that causes an increase in hydrocarbon lubricant viscosity compared to viscosity of the hydrocarbon lubricant as originally formulated (i.e., new or unused hydrocarbon lubricant) or (2) that is determined by at least one of: a change in amount of atomic oxygen of at least 0.3 wt %, or an increase in Varnish Potential Rating to Elevated or higher, or an increase in ΔE of at least about 25 in the Membrane Patch Colorimetry test, wherein each of these is determined by comparison to the hydrocarbon lubricant as originally formulated (properties of an unused hydrocarbon lubricant of the lubricant's formulation). A Varnish Potential Rating of Elevated or higher as determined by ASTM D7843 is an increase in ΔE of at least about 25 in the Membrane Patch Colorimetry test. Still another method of determining when a used hydrocarbon lubricant should be treated is by monitoring the increase in color determined by Membrane Patch Colorimetry (ASTM D7843). An increase in ΔE of at least about 25, for example from about 25 to about 60, should be treated with the polyhydroxy polypropylene oxide homopolymer having a hydroxyl number of from about 12 mg KOH/g to about 58 mg KOH/g.

When a used hydrocarbon lubricant has an increase or decrease in weight percent atomic oxygen by weight, for example when atomic oxygen has increased or decreased at least about 0.3 weight percent or at least about 0.4 weight percent or at least about 0.5 weight percent as compared to the weight percent of atomic oxygen of the lubricant as originally formulated (that is, the weight percent of atomic oxygen that can be accounted for by the additives used in formulating the lubricant) it typically includes a level of varnish that detrimentally affects lubricant properties or operation of the lubricated machinery and should be treated with the polyhydroxy polypropylene oxide homopolymer having a hydroxyl number of from about 12 mg KOH/g to about 58 mg KOH/g, as measured according to ASTM D4274. The method may be used to treat used hydrocarbon lubricant in which atomic oxygen is changed, for example, from 0.3 weight percent or from about 0.4 weight percent or from about 0.5 weight percent to about 0.7 weight percent or to about 0.8 weight percent or to about 0.9 weight percent or to about 1 weight percent compared to the weight percent of atomic oxygen of the lubricant as formulated.

The method of treating the used hydrocarbon lubricant comprises adding to the used hydrocarbon lubricant from about 2 percent by weight to about 20 percent by weight of the polyhydroxy polypropylene oxide homopolymer having a hydroxyl number of from about 12 mg KOH/g to about 58 mg KOH/g, based on weight of the used hydrocarbon lubricant. That is, for every 100 parts by weight of the used hydrocarbon lubricant, 2 to 20 parts by weight of polyhydroxy polypropylene oxide homopolymer having a hydroxyl number of from about 12 mg KOH/g to about 58 mg KOH/g is added. In general, a lesser amount of the polyhydroxy polypropylene oxide homopolymer can be used as the used hydrocarbon lubricant's ISO Viscosity Grade increases. In general, it may be advantageous to use a polyhydroxy polypropylene oxide homopolymer having a viscosity within about 80% to about 300/% of the used hydrocarbon lubricant viscosity, although addition of a higher viscosity polyhydroxy polypropylene oxide homopolymer tends to have much less of an effect on viscosity than expected theoretically due to its action in re-dissolving the varnish in the used hydrocarbon lubricant. In various embodiments, the polyhydroxy polypropylene oxide homopolymer may have a hydroxyl number of from about 12 mg KOH/g or from about 13 mg KOH/g or from about 14 mg KOH/g or from about 15 mg KOH/g or from about 16 mg KOH/g or from about 17 mg KOH/g or from about 18 mg KOH/g or from about 19 mg KOH/g or from about 20 mg KOH/g or from about 21 mg KOH/g or from about 22 mg KOH/g to about 58 mg KOH/g or to about 56 mg KOH/g or to about 53 mg KOH/g or to about 50 mg KOH/g or to about 47 mg KOH/g or to about 44 mg KOH/g or to about 42 mg KOH/g or to about 40 mg KOH/g or to about 38 mg KOH/g or to about 36 mg KOH/g or to about 34 mg KOH/g or to about 32 mg KOH/g or to about 31 mg KOH/g or to about 30 mg KOH/g or to about 29 mg KOH/g or to about 28 mg KOH/g or to about 27 mg KOH/g or to about 26 mg KOH/g or to about 25 mg KOH/g as measured according to ASTM D4274.

Suitable polyhydroxy polypropylene oxide homopolymers may be prepared from polypropylene oxide using water, diols such as ethylene glycol and polypropylene glycol, or polyols such as glycerine, trimethylolpropane, or pentaerythritol as an initiator compound. Preferably, the initiator compound is water or a polyol having two to four carbon atoms, more preferably two or three carbon atoms. Polyhydroxy polypropylene oxide homopolymers having a hydroxyl number of from about 12 mg KOH/g to about 58 mg KOH/g are commercially available, for example under the VORANOL trademark from The Dow Chemical Company of Midland, Mich.

The optimum amount of the polyhydroxy polypropylene oxide homopolymer to be added to the used hydrocarbon lubricant can be determined in a straightforward fashion by adding the polyhydroxy polypropylene oxide homopolymer to the used hydrocarbon lubricant in incremental amounts and observing the effect on Membrane Patch Colorimetry (ΔE). Typically, the improvement in Membrane Patch Colorimetry (ΔE) is accompanied by loss of cloudiness in the used oil. When the lubricant was formulated with emulsifiers, relatively more of the polyhydroxy polypropylene oxide homopolymer may need to be added to the used hydrocarbon lubricant.

In various embodiments, at least about 2 percent by weight or at least about 3 percent by weight or at least about 4 percent by weight or at least about 5 percent by weight or at least about 6 percent by weight or at least about 7 percent by weight or at least about 8 percent by weight or at least about 9 percent by weight or at least about 10 percent by weight of the polyhydroxy polypropylene oxide homopolymer is added to the used hydrocarbon lubricant and up to about 20 percent by weight or up to about 19 percent by weight or up to about 18 percent by weight or up to about 17 percent by weight or up to about 16 percent by weight or up to about 15 percent by weight or up to about 14 percent by weight or up to about 13 percent by weight or up to about 12 percent by weight or up to about 11 percent by weight or up to about 10 percent by weight of the polyhydroxy polypropylene oxide homopolymer may be added to the used hydrocarbon lubricant, in each case based on the weight of the used hydrocarbon lubricant. For example, from about 2 percent by weight to about 19 percent by weight or from about 2 percent by weight to about 18 percent by weight or from about 2 percent by weight to about 17 percent by weight or from about 2 percent by weight to about 16 percent by weight or from about 2 percent by weight to about 15 percent by weight or from about 2 percent by weight to about 14 percent by weight or from about 2 percent by weight to about 13 percent by weight or from about 2 percent by weight to about 12 percent by weight or from about 2 percent by weight to about 11 percent by weight or from about 2 percent by weight to about 10 percent by weight of the polyhydroxy polypropylene oxide homopolymer may be added to the used hydrocarbon lubricant, in each case based on the weight of the used hydrocarbon lubricant.

By way of further examples, from about 3 percent by weight to about 20 percent by weight or from about 3 percent by weight to about 19 percent by weight or from about 3 percent by weight to about 18 percent by weight or from about 3 percent by weight to about 17 percent by weight or from about 3 percent by weight to about 16 percent by weight or from about 3 percent by weight to about 15 percent by weight or from about 3 percent by weight to about 14 percent by weight or from about 3 percent by weight to about 13 percent by weight or from about 3 percent by weight to about 12 percent by weight or from about 3 percent by weight to about 11 percent by weight or from about 3 percent by weight to about 10 percent by weight of the polyhydroxy polypropylene oxide homopolymer may be added to the used hydrocarbon lubricant, in each case based on the weight of the used hydrocarbon lubricant.

By way of further examples, from about 4 percent by weight to about 20 percent by weight or from about 4 percent by weight to about 19 percent by weight or from about 4 percent by weight to about 18 percent by weight or from about 4 percent by weight to about 17 percent by weight or from about 4 percent by weight to about 16 percent by weight or from about 4 percent by weight to about 15 percent by weight or from about 4 percent by weight to about 14 percent by weight or from about 4 percent by weight to about 13 percent by weight or from about 4 percent by weight to about 12 percent by weight or from about 4 percent by weight to about 11 percent by weight or from about 4 percent by weight to about 10 percent by weight of the polyhydroxy polypropylene oxide homopolymer may be added to the used hydrocarbon lubricant, in each case based on the weight of the used hydrocarbon lubricant.

By way of further examples, from about 5 percent by weight to about 20 percent by weight or from about 5 percent by weight to about 19 percent by weight or from about 5 percent by weight to about 18 percent by weight or from about 5 percent by weight to about 17 percent by weight or from about 5 percent by weight to about 16 percent by weight or from about 5 percent by weight to about 15 percent by weight or from about 5 percent by weight to about 14 percent by weight or from about 5 percent by weight to about 13 percent by weight or from about 5 percent by weight to about 12 percent by weight or from about 5 percent by weight to about 11 percent by weight or from about 5 percent by weight to about 10 percent by weight of the polyhydroxy polypropylene oxide homopolymer may be added to the used hydrocarbon lubricant, in each case based on the weight of the used hydrocarbon lubricant.

By way of further examples, from about 6 percent by weight to about 20 percent by weight or from about 6 percent by weight to about 19 percent by weight or from about 6 percent by weight to about 18 percent by weight or from about 6 percent by weight to about 17 percent by weight or from about 6 percent by weight to about 16 percent by weight or from about 6 percent by weight to about 15 percent by weight or from about 6 percent by weight to about 14 percent by weight or from about 6 percent by weight to about 13 percent by weight or from about 6 percent by weight to about 12 percent by weight or from about 6 percent by weight to about 11 percent by weight or from about 6 percent by weight to about 10 percent by weight of the polyhydroxy polypropylene oxide homopolymer may be added to the used hydrocarbon lubricant, in each case based on the weight of the used hydrocarbon lubricant.

By way of further examples, from about 7 percent by weight to about 20 percent by weight or from about 7 percent by weight to about 19 percent by weight or from about 7 percent by weight to about 18 percent by weight or from about 7 percent by weight to about 17 percent by weight or from about 7 percent by weight to about 16 percent by weight or from about 7 percent by weight to about 15 percent by weight or from about 7 percent by weight to about 14 percent by weight or from about 7 percent by weight to about 13 percent by weight or from about 7 percent by weight to about 12 percent by weight or from about 7 percent by weight to about 11 percent by weight or from about 7 percent by weight to about 10 percent by weight of the polyhydroxy polypropylene oxide homopolymer may be added to the used hydrocarbon lubricant, in each case based on the weight of the used hydrocarbon lubricant.

By way of further examples, from about 8 percent by weight to about 20 percent by weight or from about 8 percent by weight to about 19 percent by weight or from about 8 percent by weight to about 18 percent by weight or from about 8 percent by weight to about 17 percent by weight or from about 8 percent by weight to about 16 percent by weight or from about 8 percent by weight to about 15 percent by weight or from about 8 percent by weight to about 14 percent by weight or from about 8 percent by weight to about 13 percent by weight or from about 8 percent by weight to about 12 percent by weight or from about 8 percent by weight to about 11 percent by weight or from about 8 percent by weight to about 10 percent by weight of the polyhydroxy polypropylene oxide homopolymer may be added to the used hydrocarbon lubricant, in each case based on the weight of the used hydrocarbon lubricant.

By way of further examples, from about 9 percent by weight to about 20 percent by weight or from about 9 percent by weight to about 19 percent by weight or from about 9 percent by weight to about 18 percent by weight or from about 9 percent by weight to about 17 percent by weight or from about 9 percent by weight to about 16 percent by weight or from about 9 percent by weight to about 15 percent by weight or from about 9 percent by weight to about 14 percent by weight or from about 9 percent by weight to about 13 percent by weight or from about 9 percent by weight to about 12 percent by weight or from about 9 percent by weight to about 11 percent by weight or from about 9 percent by weight to about 10 percent by weight of the polyhydroxy polypropylene oxide homopolymer may be added to the used hydrocarbon lubricant, in each case based on the weight of the used hydrocarbon lubricant.

By way of further examples, from about 10 percent by weight to about 20 percent by weight or from about 10 percent by weight to about 19 percent by weight or from about 10 percent by weight to about 18 percent by weight or from about 10 percent by weight to about 17 percent by weight or from about 10 percent by weight to about 16 percent by weight or from about 10 percent by weight to about 15 percent by weight or from about 10 percent by weight to about 14 percent by weight or from about 10 percent by weight to about 13 percent by weight or from about 10 percent by weight to about 12 percent by weight or from about 10 percent by weight to about 11 percent by weight of the polyhydroxy polypropylene oxide homopolymer may be added to the used hydrocarbon lubricant, in each case based on the weight of the used hydrocarbon lubricant.

In various embodiments, the used hydrocarbon lubricant comprises a Group II hydrocarbon oil or Group III hydrocarbon oil and one or more lubricant additives and has a kinematic viscosity at 40° C. of from about 40 centistokes to about 352 centistokes or is one of ISO Viscosity Grades 46, 68, 100, 150, 220, or 320, wherein the method comprises adding to the used hydrocarbon lubricant at least about 2 percent by weight or at least about 3 percent by weight or at least about 4 percent by weight or at least about 5 percent by weight or at least about 6 percent by weight or at least about 7 percent by weight or at least about 8 percent by weight or at least about 9 percent by weight or at least about 10 percent by weight and up to about 20 percent by weight or up to about 19 percent by weight or up to about 18 percent by weight or up to about 17 percent by weight or up to about 16 percent by weight or up to about 15 percent by weight or up to about 14 percent by weight or up to about 13 percent by weight or up to about 12 percent by weight or up to about 11 percent by weight or up to about 10 percent by weight, based on the weight of the used hydrocarbon lubricant, of a polyhydroxy polypropylene oxide homopolymer having a hydroxyl number of from about 25 mg KOH/g to about 58 g KOH/g as measured according to ASTM D4274. The used hydrocarbon lubricant has varnish or sludge or has a Varnish Potential Rating of Elevated or higher or has a change in weight percent of atomic oxygen of at least about 0.3 weight percent more than the weight percent of atomic oxygen of the lubricant as formulated or has an increase in ΔE of at least about 25 determined by Membrane Patch Colorimetry (ASTM D7843). In various embodiments, the polyhydroxy polypropylene oxide homopolymer may have a hydroxyl number of from about 25 mg KOH/g or from about 26 mg KOH/g or from about 27 mg KOH/g or from about 28 mg KOH/g to about 58 mg KOH/g or to about 56 mg KOH/g or to about 54 mg KOH/g or to about to about 52 mg KOH/g or to about 50 mg KOH/g or to about 48 mg KOH/g or to about 46 mg KOH/g or to about 44 mg KOH/g or to about 42 mg KOH/g or to about 40 mg KOH/g or to about 38 mg KOH/g or to about 36 mg KOH/g or to about 34 mg KOH/g or 32 mg KOH/g or to about 31 mg KOH/g or to about 30 mg KOH/g or to about 29 mg KOH/g or to about 28 mg KOH/g as measured according to ASTM 4274. For example, the polyhydroxy polypropylene oxide homopolymer may have a hydroxyl number of from about 25 mg KOH/g to about 56 mg KOH/g; or from about 25 mg KOH/g to about 50 mg KOH/g; or from about 25 mg KOH/g to about 46 mg KOH/g; or from about 25 mg KOH/g to about 40 mg KOH/g; or from about 25 mg KOH/g to about 36 mg KOH/g; or from about 25 mg KOH/g to about 32 mg KOH/g; or from about 25 mg KOH/g to about 30 mg KOH/g; or from about 25 mg KOH/g to about 28 mg KOH/g. In other embodiments, the polyhydroxy polypropylene oxide homopolymer may have a hydroxyl number of from about 26 mg KOH/g to about 58 mg KOH/g; or from about 26 mg KOH/g to about 54 mg KOH/g; or from about 26 mg KOH/g to about 50 mg KOH/g; or from about 26 mg KOH/g to about 46 mg KOH/g; or from about 26 mg KOH/g to about 40 mg KOH/g; or from about 26 mg KOH/g to about 36 mg KOH/g or from about 26 mg KOH/g to about 32 mg KOH/g; or from about 26 mg KOH/g to about 30 mg KOH/g or from about 26 mg KOH/g to about 28 mg KOH/g. In still other embodiments, the polyhydroxy polypropylene oxide homopolymer may have a hydroxyl number of from about 27 mg KOH/g to about 58 mg KOH/g; or from about 27 mg KOH/g to about 54 mg KOH/g; or from about 27 mg KOH/g to about 50 mg KOH/g or from about 27 mg KOH/g to about 46 mg KOH/g; or from about 27 mg KOH/g to about 40 mg KOH/g; or from about 27 mg KOH/g to about 36 mg KOH/g; or from about 27 mg KOH/g to about 32 mg KOH/g; or from about 27 mg KOH/g to about 30 mg KOH/g. In other embodiments, the polyhydroxy polypropylene oxide homopolymer may have a hydroxyl number of from about 28 mg KOH/g to about 58 mg KOH/g; or from about 28 mg KOH/g to about 54 mg KOH/g; or from about 28 mg KOH/g to about 50 mg KOH/g; or from about 28 mg KOH/g to about 46 mg KOH/g; or from about 28 mg KOH/g to about 40 mg KOH/g; or from about 28 mg KOH/g to about 36 mg KOH/g; or from about 28 mg KOH/g to about 32 mg KOH/g; or from about 28 mg KOH/g to about 30 mg KOH/g.

In various embodiments, the used hydrocarbon lubricant comprises a Group II hydrocarbon oil or Group III hydrocarbon oil and one or more lubricant additives, and has a kinematic viscosity at 40° C. of from about 288 centistokes to about 1650 centistokes or has an ISO Viscosity Grade of from 320 to 1500, measured according to ISO 3448, wherein the method comprises adding to the used hydrocarbon lubricant at least about 2 percent by weight or at least about 3 percent by weight or at least about 4 percent by weight or at least about 5 percent by weight or at least about 6 percent by weight or at least about 7 percent by weight or at least about 8 percent by weight or at least about 9 percent by weight or at least about 10 percent by weight and up to about 20 percent by weight or up to about 19 percent by weight or up to about 18 percent by weight or up to about 17 percent by weight or up to about 16 percent by weight or up to about 15 percent by weight or up to about 14 percent by weight or up to about 13 percent by weight or up to about 12 percent by weight or up to about 11 percent by weight or up to about 10 percent by weight, based on the weight of the used hydrocarbon lubricant, of a polyhydroxy polypropylene oxide homopolymer having a hydroxyl number of from about 12 mg KOH/g to about 20 mg KOH/g as measured according to ASTM D4274. The used hydrocarbon lubricant has varnish or sludge or has a Varnish Potential Rating of Elevated or higher or has a change in weight percent of atomic oxygen of at least about 0.3 weight percent more than the weight percent of atomic oxygen of the lubricant as formulated or has an increase in ΔE of at least about 25 determined by Membrane Patch Colorimetry (ASTM D7843). In various embodiments, the polyhydroxy polypropylene oxide homopolymer may have a hydroxyl number of from about 12 mg KOH/g or from about 13 mg KOH/g or from about 14 mg KOH/g or from about 15 mg KOH/g to about 20 mg KOH/g or to about 19 mg KOH/g or to about 18 mg KOH/g or to about 17 mg KOH/g or to about 16 mg KOH/g or to about 15 mg KOH/g as measured according to ASTM D4274. For example, the polyhydroxy polypropylene oxide homopolymer may have a hydroxyl number of from about 12 mg KOH/g to about 19 mg KOH/g; or from about 12 mg KOH/g to about 18 mg KOH/g; or from about 12 mg KOH/g to about 17 mg KOH/g; or from about 12 mg KOH/g to about 16 mg KOH/g; or from about 12 mg KOH/g to about 15 mg KOH/g. In other examples, the polyhydroxy polypropylene oxide homopolymer may have a hydroxyl number of from about 13 mg KOH/g to about 20 mg KOH/g or from about 13 mg KOH/g to about 19 mg KOH/g; or from about 13 mg KOH/g to about 18 mg KOH/g; or from about 13 mg KOH/g to about 17 mg KOH/g; or from about 13 mg KOH/g to about 16 mg KOH/g; or from about 13 mg KOH/g to about 15 mg KOH/g. In still other examples, the polyhydroxy polypropylene oxide homopolymer may have a hydroxyl number of from about 14 mg KOH/g to about 20 mg KOH/g; or from about 14 mg KOH/g to about 19 mg KOH/g; or from about 14 mg KOH/g to about 18 mg KOH/g; or from about 14 mg KOH/g to about 17 mg KOH/g; or from about 14 mg KOH/g to about 16 mg KOH/g; or from about 14 mg KOH/g to about 15 mg KOH/g. In still further examples, the polyhydroxy polypropylene oxide homopolymer may have a hydroxyl number of from about 15 mg KOH/g to about 20 mg KOH/g; or from about 15 mg KOH/g to about 19 mg KOH/g; or from about 15 mg KOH/g to about 18 mg KOH/g; or from about 15 mg KOH/g to about 17 mg KOH/g; or from about 15 mg KOH/g to about 16 mg KOH/g.

The polyhydroxy polypropylene oxide homopolymer is not amphiphilic and does not form micelles as would a surfactant. Rather, it is understood that the polyhydroxy polypropylene oxide homopolymer changes the characteristics of the lubricant to permit the varnish to dissolve in the lubricant. Testing for Varnish Potential Rating shows the used lubricant returned to good working condition by the disclosed method of treating the used hydrocarbon lubricant with the polyhydroxy polypropylene oxide homopolymer.

The used hydrocarbon lubricant includes one or more additives suited for the particular use to which the lubricant is put. The used hydrocarbon lubricant is free of zinc dialkylthiophosphate and other zinc coordination compounds and preferably free of additives dispersed with surfactants and/or dispersants. Nonlimiting examples of additives with which the lubricant may be formulated include extreme pressure and antiwear additives antioxidants, friction-reducing agents, metal inactivating agents such as benzotriazoles, viscosity modifiers, pour point depressants, stabilizers, corrosion inhibitors, and flammability suppressants. Such additives may be present singly or in any combination of two or more. There are no particular restrictions on the inclusion of such additives in the used hydrocarbon lubricant. Generally, additives such as these may be present at less than or equal to about 10% by weight of the lubricant composition. Various embodiments of the used hydrocarbon lubricant may include about 0.1 to about 5% by weight of an additive or a combination of additives or about 0.2 to about 2% by weight of an additive or a combination of additives.

Nonlimiting examples of the antioxidants that can be used include phenolic antioxidants such as 2,6-di-t-butyl-4-methylphenol and 4,4'-methylenebis(2,6-di-t-butylphenol), and bisphenol A; amine and thiazine antioxidants such as p,p-dioctylphenylamine, monooctyldiphenylamine, phenothiazine, 3,7-dioctylphenothiazine, N,N-di(2-naphthyl)-p-phenylenediamine, phenyl-1-naphthylamine, phenyl-2-naphthylamine, alkylphenyl-1-naphthylamines, and alkylphenyl-2-naphthylamines; and sulfur-containing antioxidants such as alkyl disulfide, thiodipropionic acid esters and benzothiazole. The lubricant composition may comprise up to about 5.0 weight % antioxidants, about 0.1 to about 5 weight %, about 0.1 to about 2.0 weight %, or about 0.2 to about 0.8 weight % antioxidants. The lubricant compositions may include one or a combination of two or more antioxidant compounds.

In certain embodiments, the used hydrocarbon lubricant may include one or more extreme pressure or anti-wear additives. Nonlimiting examples of suitable extreme pressure/antiwear additives include sulfur- and phosphorous-containing types such as phosphoric acid esters, acidic phosphoric acid esters, branched alkyl amine phosphates containing 5 to 20 carbon atoms, thiophosphoric acid esters, acidic phosphoric acid ester amine salts, and chlorinated phosphoric acid esters and phosphorous acid esters that are esters of phosphoric acid or phosphorous acid with alkanols or polyether alcohols. Specific, nonlimiting examples of phosphoric acid esters include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate, and xylenyldiphenyl phosphate. Specific, nonlimiting examples of acidic phosphoric acid esters there may be mentioned monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate and dioleyl acid phosphate. Specific, nonlimiting examples of thiophosphoric acid esters include tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate, and xylenyldiphenyl phosphorothionate. Specific, nonlimiting examples of amine salts of acidic phosphoric acid esters include salts of acidic phosphoric acid esters with amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine, and trioctylamine. Specific, nonlimiting examples of chlorinated phosphoric acid esters include tris(dichloropropyl) phosphate, tris(chloroethyl) phosphate, tris(chlorophenyl) phosphate, and polyoxyalkylene bis[di(chloroalkyl)]phosphate. As phosphorous acid esters there may be mentioned dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite, and tricresyl phosphite. The extreme pressure/antiwear additives may be present individually or in any combination, in any desired amount. In various embodiments, the used hydrocarbon lubricant may include about 0.01 weight % to about 5.0 weight %, about 0.01 weight % to about 4.0 weight %, about 0.02 weight % to about 3.0 weight %, or 0.1 weight % to about 5.0 weight % each of extreme pressure additives and antiwear additives.

In various embodiments, the used hydrocarbon lubricant may include one or more corrosion inhibitors, such as those selected from isomeric mixtures of N,N-bis(2-ethylhexyl)-4-methyl-1H-benzotriazole-1-methylamine and N,N-bis(2-ethylhexyl)-5-methyl-1H-benzotriazole-1-methylamine. The used hydrocarbon lubricant may include about 0.01 to about 1.0 weight % of one or more corrosion inhibitors, about 0.01 to about 0.5 weight % of one or more corrosion inhibitors, or about 0.05 to about 0.15 weight % of one or more corrosion inhibitors.

Viscosity modifiers (or viscosity index improvers) are polymeric materials, typical examples of these being polyolefins, such as ethylene-propylene copolymers, hydrogenated styrene-isoprene block copolymers, hydrogenated copolymers of styrene-butadiene, acrylic polymers produced by polymerization of acrylate and methacrylate esters, hydrogenated isoprene polymers, polyalkyl styrenes, hydrogenated alkenyl arene conjugated diene copolymers, polyolefins, esters of maleic anhydride-styrene copolymers, and polyisobutylene.

Nonlimiting examples of pour point depressants include polyalkyl methacrylates, polyalkyl acrylates, polyvinyl acetate, polyalkylstylenes, polybutene, condensates of chlorinated paraffin and naphthalene, and condensates of chlorinated paraffin and phenol.

Nonlimiting examples of flammability suppressants include trifluorochloromethane, trifluoroiodomethane, phosphate esters and other phosphorous compounds, and iodine- or bromine-containing hydrocarbons, hydroflorocarbons, or fluorocarbons.

A composition comprising the polyhydroxy polypropylene oxide homopolymer and at least one additive other than zinc dialkylthiophosphate and other zinc coordination compounds and dispersed (solid) additives may be added to the used hydrocarbon lubricant in the disclosed method. In various embodiments, the additive is selected from antioxidants, anti-wear agents, extreme-pressure agents, friction-reducing agents, metal inactivating agents such as benzotriazoles, viscosity modifiers, pour point depressants, stabilizers, corrosion inhibitors, flammability suppressants, and combinations of these. In particular embodiments, the composition used to treat the used hydrocarbon lubricant may comprise the polyhydroxy polypropylene oxide homopolymer and an antioxidant. The composition used to treat the used hydrocarbon lubricant may comprise up to about 1.5 weight percent of one or more antioxidant additives, up to 0.75 weight percent of one or more lubricity additives, up to 0.5 weight percent of one or more corrosion inhibitor additives, or any combination thereof.

The hydrocarbon lubricant may be formulated with dispersed (solid) additives and dispersed additives may have been added to the hydrocarbon lubricant during use but before treatment by the presently disclosed method. While not wishing to be bound by theory, it is believed that such dispersed additives become entrained in the varnish and sludge of used hydrocarbon lubricant. It is often necessary to add a larger amount of the polyhydroxy polypropylene oxide homopolymer than would be needed if dispersed additives had not been added to the hydrocarbon lubricant It is observed that the polyhydroxy polypropylene oxide homopolymer may have a higher viscosity that the hydrocarbon lubricant while keeping the treated hydrocarbon lubricant within 10% of the kinematic viscosity at 40° C. of the ISO Viscosity Grade for the hydrocarbon lubricant, which is believed to be due to reincorporation of material from the sludge and varnish.

EXAMPLES

Amounts are given in parts by weight unless specifically indicated to be in a different unit.

The polyhydroxy polypropylene oxide homopolymer compositions were prepared using the materials shown in the following table. The ingredients were combined, then heated with mixing to homogenize. Each example composition was then evaluated for the properties shown in the following table.

| Ingredient | Source of ingredient | Example 1 (parts by weight) | Example 2 (parts by weight) | Example 3 (parts by weight) |
|---|---|---|---|---|
| Voranol 2000LM[1] | Dow Chemical Company | 495 | | |
| Voranol 4000LM[2] | Dow Chemical Company | | 495 | |
| Voranol 8000LM[3] | Dow Chemical Company | | | |
| Wingstay L Flakes (LENOXI AO 382) | | 2.99 | 3.02 | |
| Alkaterge E | | 1.01 | 1.01 | |
| Cobratec 122 | | 1.0 | 1.0 | |
| Surtech OA 3321 | | 0.5 | 0.5 | |

| Property | Test Method | Example 1 | Example 2 | Example 3 |
|---|---|---|---|---|
| Viscosity at 40° C. | ASTM D445 | 178.4 cSt | 481.8 cSt | 1502.69 cSt |
| Pour Point | ASTM D97 | −30° C. | −30° C. | −30° C. |
| Density at 15° C. | ASTM D4052 | 1.009 g/cm$^3$ | 1.007 g/cm$^3$ | 1.004 g/cm$^3$ |
| Flash Point | ASTM D93 | 174° C. | 145° C. | 144° C. |
| Total Acid Number | ASTM D664 | 0.16 mg KOH/g | 0.15 mg KOH/g | 0.15 mg KOH/g |
| Hydroxyl Number | ASTM D4274 | 56 mg KOH/g | 27 mg KOH/g | 14 mg KOH/g |

[1]Voranol 2000LM is a linear dihydroxy polypropylene oxide haying a hydroxyl number of 56 mg KOH/g (determined by ASTM D4274).
[2]Voranol 4000LM is a linear dihydroxy polypropylene oxide having a hydroxyl number of 27 mg KOH/g (determined by ASTM D4274).
[3]Voranol 8000LM is a linear dihydroxy polypropylene oxide having a hydroxyl number of 14 mg KOH/g (determined by ASTM D4274).

Examples 4-7

A sample of a used hydrocarbon lubricant was obtained and divided into four portions to make Examples 4-7. Example 4 is a first portion of the used hydrocarbon lubricant that was not treated. Example 5 was prepared by adding to a second portion of the used hydrocarbon lubricant 10% by weight of Example 1. Example 6 was prepared by adding to a second portion of the used hydrocarbon lubricant 10% by weight of Example 2. Example 7 was prepared by adding to a second portion of the used hydrocarbon lubricant 10% by weight of Example 3. Properties of the Examples were measured and are provided in the table below.

| Property | Example 4 | Example 5 | Example 6 | Example 7 |
|---|---|---|---|---|
| Visual Appearance | Clear Orange | Cloudy-Orange | Cloudy-Orange | Cloudy Orange |

-continued

| Property | Example 4 | Example 5 | Example 6 | Example 7 |
|---|---|---|---|---|
| Viscosity (cSt) | 63.50 | 69.41 | 68.95 | 75.08 |
| Total Acid Number (mg KOH/g) | 0.20 | 0.15 | 0.24 | 0.15 |
| Water (ppm) | 630 | 682 | 507 | 921 |
| Tramp Oil % (T) | No | No | No | No |
| Membrane Patch Colorimetry (ΔE) | 48.5 | 4.7 | 13.2 | 24.0 |
| Atomic Oxygen wt % | 4.5 | 5.5 | 5.1 | 4.6 |
| Density at 15° C. ($g/cm^3$) | 0.8764 | 0.8819 | 0.8798 | 0.8773 |

The testing shows that as the amount of hydroxyl content of the polyhydroxy polypropylene oxide homopolymer composition decreases, the Membrane Patch Colorimetry value (ΔE) rises. Example 5 shows that the Example 1 polyhydroxy polypropylene oxide composition was the most effective for treating this used hydrocarbon lubricant. Reduction in the Membrane Patch Colorimetry value to 4.7 without a substantial change in viscosity indicates that the agglomerated varnish has been dissolved into the liquid phase of the lubricant Example 1 also has a viscosity that is closest to the used lubricant viscosity of the three polyhydroxy polypropylene oxide compositions tested.

Examples 8-10

A sample of a used hydrocarbon lubricant was obtained and divided into three portions to make Examples 8-10. Example 8 is a first portion of the used hydrocarbon lubricant that was not treated. Example 9 was prepared by adding to a second portion of the used hydrocarbon lubricant 5% by weight of Example 3. Example 10 was prepared by adding to a second portion of the used hydrocarbon lubricant 10% by weight of Example 3. Properties of the Examples were measured and are provided in the table below. The same properties are given for Example 3 itself. Also given in the table are the properties that would theoretically be expected by adding 5% by weight and 10% by weight of the Example 3 linear, dihydroxy-terminated polypropylene oxide composition if the Example 3 linear, dihydroxy-terminated polypropylene oxide composition were to have no effect on varnish contained in the used hydrocarbon oil.

| Property | Ex. 3 | Ex. 8 | Ex. 9 | Theoretical result for Ex. 9 | Ex. 10 | Theoretical result for Ex. 10 |
|---|---|---|---|---|---|---|
| Visual Appearance | Clear-Colorless | | SltHazy-Yellow | Clear-Colorless | | Clear-LtYellow |
| Viscosity (cSt) | 1502.69 | 44.70 | 45.93 | 117.60 | 54.29 | 190.50 |
| Total Acid Number (mg KOH/g) | 0.14 | 0.21 | 0.20 | 0.21 | 0.17 | 0.20 |
| Water (ppm) | 2471 | 277 | 1065 | 386.7 | 367 | 496.4 |
| Tramp Oil % (T) | No | No | No | No | No | No |
| Membrane Patch Colorimetry (ΔE) | 5.0 | 18.2 | 17.8 | 17.5 | 16.1 | 16.9 |
| Atomic Oxygen wt % | 33.4 | 0.6 | 1.3 | 2.3 | 2.2 | 3.9 |
| Density at 15° C. ($g/cm^3$) | 1.0057 | 0.8408 | 0.8440 | 0.8490 | 0.8488 | 0.8573 |

The testing of Examples 8-10 demonstrate that, due to the effect of the polyhydroxy polypropylene oxide composition on varnish in the used lubricant, the addition of the polyhydroxy polypropylene oxide composition has less effect on lubricant viscosity that is predicted theoretically. Addition of Example 3 would be expected to significantly increase the viscosity of the used lubricant because its viscosity is much higher than that of the used lubricant, but it does not. The reduction in Total Acid Number demonstrates that the Example 3 composition has dissolved varnish agglomerations and re-dissolved entrained antioxidants into the used lubricant.

Example 11

A composition of a polyalkylene oxides having at least one hydrocarbyl end group according to Kovanda et al., U.S. Pat. No. 8,685,905 was prepared by combining the ingredients listed in the table below properties of Example 11 were measured and are provided in the following table.

| Ingredient | Source of ingredient | Example 11 (parts by weight) |
|---|---|---|
| ? | ? | 495 |
| Wingstay L Flakes (LENOXI AO 382) | | 2.99 |
| Alkaterge E | | 1.01 |
| Cobratec 122 | | 1.0 |
| Surtech OA 3321 | | 0.5 |
| **Property** | **Test Method** | **Example 11** |
| Viscosity at 40° C. | ASTM D445 | |
| Pour Point | ASTM D97 | |
| Density at 15° C. | ASTM D4052 | _$g/cm^3$ |
| Flash Point | ASTM D93 | _° C. |
| Total Acid Number | ASTM D664 | _mg KOH/g |
| Hydroxyl Number | ASTM D4274 | _mg KOH/g |

Examples 12-14

A sample of a used hydrocarbon lubricant was obtained and divided into three portions to make Examples 12-14. Example 12 is a first portion of the used hydrocarbon lubricant that was not treated. Example 13 was prepared by adding to a second portion of the used hydrocarbon lubricant 10% by weight of the Example 11. Example 14 was prepared by adding to a second portion of the used hydrocarbon lubricant 10% by weight of the Example 1 polypropylene oxide composition. Properties of the Examples were measured and are provided in the table below.

| Property | Example 12 | Example 13 | Example 14 |
|---|---|---|---|
| Visual Appearance | Hazy-Brown | Hazy-Brown | Clear-Brown |
| Viscosity (cSt) | 61.81 | 53.70 | 76.16 |
| Total Acid Number (mg KOH/g) | 0.91 | 0.51 | 0.49 |
| Water (ppm) | 96 | 204 | 442 |
| Tramp Oil % (T) | No | No | No |
| Membrane Patch Colorimetry (ΔE) | 41.84 | 48.59 | 19.50 |
| Atomic Oxygen wt % | 5.6 | 7.2 | 7.8 |
| Density at 15° C. ($g/cm^3$) | 0.8824 | 0.8903 | 0.8936 |

Example 13 has a reduced viscosity that is below the viscosity range for an ISO VG 68 lubricants according to ISO 3448. Example 13 also remains hazy; the total acid number is decreased, but the Membrane Patch Colorimetry (ΔE) measurement is not reduced, indicating that varnish agglomerations remain in the lubricant. In contrast, the total acid number of Example 14 has been reduced, the lubricant is clear, and the Membrane Patch Colorimetry (ΔE) measurement has been sharply reduced to less than half of the value for the untreated lubricant.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A method, comprising:

adding to a hydrocarbon lubricant comprising a Group II or Group III oil and sludge or varnish from about 2 percent by weight to about 20 percent by weight of a polyhydroxy polypropylene oxide homopolymer having a hydroxyl number of from about 12 mg KOH/g to about 58 mg KOH/g, based on the weight of the used hydrocarbon lubricant, wherein the hydrocarbon lubricant has an ISO Viscosity Grade of at least 46 and is free of zinc dialkylthiophosphate and other zinc coordination compounds.

2. A method according to claim 1, wherein the hydrocarbon lubricant has a Varnish Potential Rating of Elevated or higher.

3. A method according to claim 1, wherein the hydrocarbon lubricant has an ISO Viscosity Grade of from 46 to 220 and the polyhydroxy polypropylene oxide homopolymer has a hydroxyl number of from about 25 mg KOH/g to about 58 mg KOH/g.

4. A method according to claim 1, wherein the hydrocarbon lubricant has an ISO Viscosity Grade of from 100 to 220 and the polyhydroxy polypropylene oxide homopolymer has a hydroxyl number of from about 25 mg KOH/g to about 32 mg KOH/g.

5. A method according to claim 1, wherein the hydrocarbon lubricant has an ISO Viscosity Grade of from 220 to 1500 and the polyhydroxy polypropylene oxide homopolymer has a hydroxyl number of from about 12 mg KOH/g to about 20 mg KOH/g.

6. A method according to claim 1, wherein from about 3 percent by weight to about 17 percent by weight of the polyhydroxy polypropylene oxide homopolymer is added.

7. A method according to claim 1, wherein from about 5 percent by weight to about 14 percent by weight of the polyhydroxy polypropylene oxide homopolymer is added.

8. A method according to claim 1, wherein the hydrocarbon lubricant is free of detergent and dispersant additives.

9. A method according to claim 1, wherein the hydrocarbon lubricant is free of additives dispersed with surfactants and/or dispersants.

10. A method according to claim 1, further comprising adding to the hydrocarbon lubricant a member selected from the group consisting of antioxidants, antifoam additives, corrosion inhibitors, and combinations thereof.

11. A method, comprising:

adding to a used hydrocarbon lubricant comprising a Group II or Group III oil, in which atomic oxygen has changed by at least about 0.3 weight percent compared to the weight percent of atomic oxygen of the hydrocarbon lubricant as originally formulated, from about 2 percent by weight to about 20 percent by weight of a polyhydroxy polypropylene oxide homopolymer, based on the weight of the used hydrocarbon lubricant, wherein the hydrocarbon lubricant has an ISO Viscosity Grade of at least 46;

wherein the hydrocarbon lubricant is free of zinc lubricant additives;

wherein the polyhydroxy polypropylene oxide homopolymer has a hydroxyl number of from about 12 mg KOH/g to about 58 mg KOH/g.

12. A method according to claim 11, wherein atomic oxygen has changed by at least about 0.5 weight percent compared to the weight percent of atomic oxygen of the hydrocarbon lubricant as originally formulated.

13. A method according to claim 11, wherein the hydrocarbon lubricant has an ISO Viscosity Grade of from 46 to 220 and the polyhydroxy polypropylene oxide homopolymer has a hydroxyl number of from about 25 mg KOH/g to about 58 mg KOH/g.

14. A method according to claim 11, wherein the hydrocarbon lubricant has an ISO Viscosity Grade of from 100 to 220 and the polyhydroxy polypropylene oxide homopolymer has a hydroxyl number of from about 25 mg KOH/g to about 32 mg KOH/g.

15. A method according to claim 11, wherein the hydrocarbon lubricant has an ISO Viscosity Grade of from 220 to 1500 and the polyhydroxy polypropylene oxide homopolymer has a hydroxyl number of from about 12 mg KOH/g to about 20 mg KOH/g.

16. A method according to claim 11, wherein from about 3 percent by weight to about 17 percent by weight of the polyhydroxy polypropylene oxide homopolymer is added.

17. A method according to claim 11, wherein from about 3 percent by weight to about 14 percent by weight of the polyhydroxy polypropylene oxide homopolymer is added.

18. A method according to claim 11, wherein the hydrocarbon lubricant is free of detergent and dispersant additives.

19. A method according to claim 11, wherein the hydrocarbon lubricant is free of additives dispersed with surfactants and/or dispersants.

20. A method according to claim 11, further comprising adding to the hydrocarbon lubricant a member selected from the group consisting of antioxidants, antifoam additives, corrosion inhibitors, and combinations thereof.

21. A method, comprising:

adding to a used hydrocarbon lubricant comprising a Group II or Group III oil, which has an increase in ΔE of at least about 25 in the Membrane Patch Colorimetry test compared to the hydrocarbon lubricant as originally formulated, from about 2 percent by weight to about 20 percent by weight of a polyhydroxy polypropylene oxide homopolymer, based on the weight of the used hydrocarbon lubricant, wherein the hydrocarbon lubricant has an ISO Viscosity Grade of at least 46;

wherein the hydrocarbon lubricant is free of zinc lubricant additives;

wherein the polypropylene oxide is linear and terminated on both ends with hydroxyl groups and has a hydroxyl number of from about 12 mg KOH/g to about 58 mg KOH/g.

22. A method according to claim 21, wherein the hydrocarbon lubricant has an ISO Viscosity Grade of from 46 to 220 and the polyhydroxy polypropylene oxide homopolymer has a hydroxyl number of from about 25 mg KOH/g to about 58 mg KOH/g.

23. A method according to claim 21, wherein the hydrocarbon lubricant has an ISO Viscosity Grade of from 100 to 220 and the polyhydroxy polypropylene oxide homopolymer has a hydroxyl number of from about 25 mg KOH/g to about 32 mg KOH/g.

24. A method according to claim 21, wherein the hydrocarbon lubricant has an ISO Viscosity Grade of from 220 to 1500 and the polyhydroxy polypropylene oxide homopolymer has a hydroxyl number of from about 12 mg KOH/g to about 20 mg KOH/g.

* * * * *